United States Patent [19]

Desage

[11] Patent Number: 5,014,337

[45] Date of Patent: May 7, 1991

[54] ELECTRO-PORTABLE APPARATUS FOR THE PRODUCTION OF STEAM, PARTICULARLY FOR UNGLUING WALL COATINGS

[75] Inventor: Robert Desage, Verneuil/Seine, France

[73] Assignee: A.R.M.I.N.E.S., Paris, France

[21] Appl. No.: 416,313

[22] PCT Filed: Dec. 22, 1989

[86] PCT No.: PCT/FR88/00636

§ 371 Date: Aug. 21, 1989

§ 102(e) Date: Aug. 21, 1989

[87] PCT Pub. No.: WO89/05941

PCT Pub. Date: Jun. 29, 1989

[30] Foreign Application Priority Data

Dec. 24, 1987 [FR] France ..... 87 18142

[51] Int. Cl.[5] ..... F24F 6/08; A61H 33/12

[52] U.S. Cl. ..... 392/395; 392/404

[58] Field of Search ..... 219/271, 272, 273, 275, 219/276, 284, 288, 289; 392/394, 395, 403, 404

[56] References Cited

U.S. PATENT DOCUMENTS

| | | | |
|---|---|---|---|
| 1,518,454 | 12/1924 | Riche | 219/271 |
| 2,137,876 | 11/1938 | Hudson | 219/271 |
| 2,140,516 | 12/1938 | Cowan | 219/274 |
| 2,423,945 | 7/1947 | Osipow | 219/275 |
| 2,519,515 | 8/1950 | Turner | 219/274 |
| 2,547,865 | 4/1951 | Hanks | 219/274 |
| 2,676,239 | 4/1954 | Sanzone | 219/271 |
| 3,258,578 | 6/1966 | Ferris | 219/273 |
| 4,266,116 | 5/1981 | Bauer | 219/274 |
| 4,843,215 | 6/1989 | Wilkins | 219/271 |

FOREIGN PATENT DOCUMENTS

| | | |
|---|---|---|
| 1554411 | 1/1969 | France . |
| 2291048 | 6/1976 | France . |
| 2595052 | 9/1987 | France . |
| 223896 | 4/1943 | Switzerland . |

*Primary Examiner*—Teresa J. Walberg

*Attorney, Agent, or Firm*—McAulay Fisher Nissen Goldberg & Kiel

[57] ABSTRACT

Electro-portable apparatus for producing steam applied to a surface, usable more particularly but not exclusively for ungluing wall coatings, having a housing containing a porous body impregnated with a liquid to be vaporized, the liquid being heated up to its temperature of vaporization, the housing 2 being subdivided by a partition wall 8, 27, into two compartments, namely a rear closed compartment 9, 28 containing a steam generator 12, 13, which is formed of the porous body 12 impregnated with liquid and a heater 13 for heating this liquid, and a front compartment 11, 29 forming a vapor cavity or "steam plate", open to the outside, defined by a peripheral edge able to be applied on the surface 1 adapted to receive the vapor, and openings 31 being provided through the partition wall 27 to allow the passage of the steam, produced in the rear compartment 9, 28, towards and into the front compartment 11, 29 constituting the vapor cavity or "steam plate".

20 Claims, 3 Drawing Sheets

ELECTRO-PORTABLE APPARATUS FOR THE PRODUCTION OF STEAM, PARTICULARLY FOR UNGLUING WALL COATINGS

BACKGROUND OF THE INVENTION

The present invention relates to an electro-portable apparatus for the production of steam applied to a surface usable more particularly but not exclusively for ungluing wall coatings.

DESCRIPTION OF RELATED ART

The majority of presently known apparatus for ungluing wall coatings, such as wall paper, use a "steam plate" provided with a rubber pipe connected to a steam boiler which rests on the floor. Certain of these apparatus vaporize the water at a pressure close to atmospheric pressure and others at a pressure of 2 bars. Their operational autonomy ranges from ¾ hr. to 2 hours, 30 mins. for powers of 1500 watts to 2000 watts, and they present a time for reaching vapour phase ranging from 20 to 35 mins. They are provided with pressure and absence-of-water safety means as well as safety means for pressure maintenance for the apparatus operating at 2 bars. These known apparatus are of relatively large dimensions whilst presenting a relatively mediocre thermal yield. The steam produced is accompanied by droplets of water, which humidifies the paper too much, bringing about, on the one hand, a delay in the rise of temperature to about 75° C. and, on the other hand, a tendency of the paper to tear. Furthermore, these apparatus are relatively expensive and cannot reach a large public.

The use is also known of the "pressure cooker" for producing the steam which is conveyed via a rubber pipe connected to a "steam plate" which is found on the market. This device presents the same drawbacks as the above-mentioned apparatus, with, in addition, the dangers of knocking over and of explosion when gas cookers are used.

Different types of devices are furthermore known which use the capacity of retention of porous bodies for storing a mass of water which is vaporized when this water is heated to the desired temperature, by association of an appropriate source of energy with this porous body. These devices are principally characterized in that the liquid mass is stored in form impregnated in the porous body, with or without the presence of a mass of permanent liquid. In the case of the liquid being heated by passage of electrical current, different profiles of steam output may be obtained as a function of the density of the porous body chosen.

The present invention has for its object to overcome the drawbacks of the known steam generating apparatus by using the specific properties of the devices using a porous body for the retention of liquid to be vaporized and by adapting these devices in judicious manner.

SUMMARY OF THE INVENTION

To that end, this electro-portable apparatus for producing steam applied to a surface, usable more particularly but not exclusively for ungluing wall coatings, comprising a housing containing a porous body impregnated with the liquid to be vaporized and means for heating this liquid up to its temperature of vaporization, is characterized in that the housing is subdivided, by a partition wall, into two compartments, namely a rear closed compartment containing the steam generator itself, consisting of the porous body impregnated with liquid and the means for heating this liquid, and a front compartment forming a vaporization cavity or "steam plate", open to the outside, defined by a peripheral edge able to be applied on the surface adapted to receive the vapour, and in that openings are provided through the partition wall to allow the passage of the steam, produced in the rear compartment, towards and into the front compartment constituting the vaporization cavity or "steam plate".

The electro-portable apparatus according to the invention offers the advantage that its structure is particularly simple and that it comprises, in integrated manner, its reserve of liquid to be vaporized, allowing it for example an autonomy, without refill, of the order of 20 mins. for a low weight, the electrical control, the vaporization cavity or "steam plate" and a handle for holding the apparatus. This apparatus has a power of 1500 watts for example and it may be equipped with a steam output variator by commutation or by an electronic circuit. It produces steam virtually bereft of droplets of water and it presents an excellent thermal yield. It operates at atmospheric pressure and it produces steam very rapidly, after about two minutes when it is cold and after about 30 seconds, hot, after refill with water. This apparatus is of small dimensions for stowing away and it creates low vaporization noise. For the same power as the known apparatus, the temperature of a wallpaper to be unglued is raised in half the time. It may be made of plastics material and is then of low cost price and it may thus be used by a large public in the do-it-yourself or handicraft domain.

An embodiment of the present invention will be described hereinafter by way of non-limiting example with reference to the accompanying drawings, in which:

DESCRIPTION OF THE PREFERRED EMBODIMENTS

Figure 1:
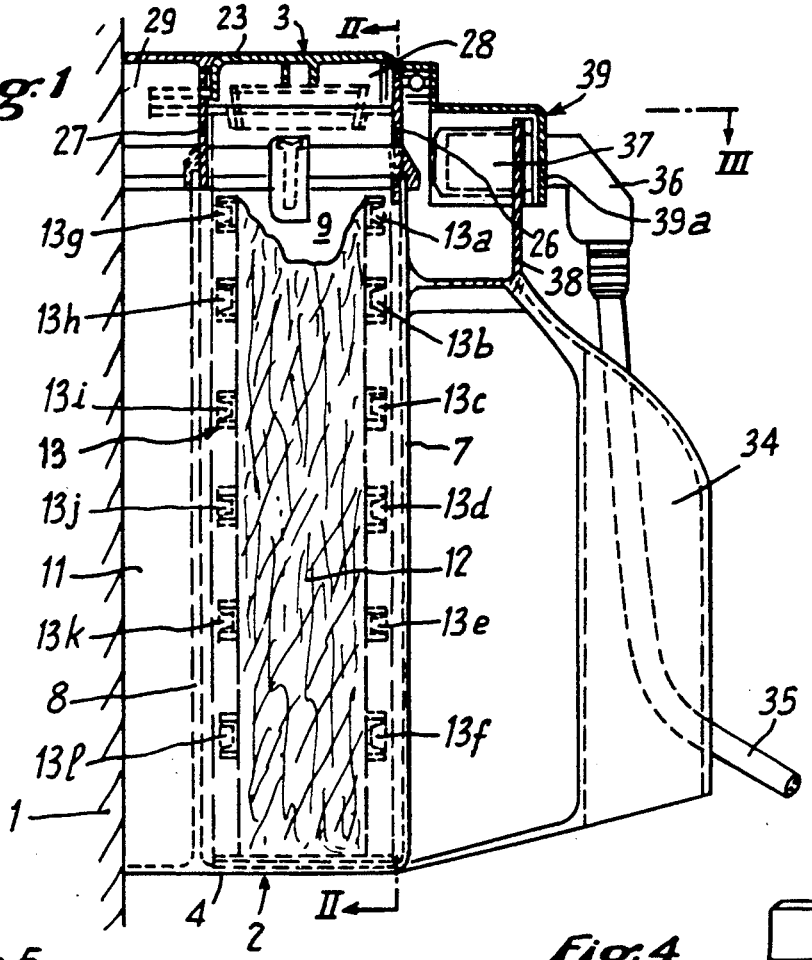
FIG. 1 is a view in vertical section of an electro-portable steam generating apparatus according to the invention, in a transverse plane perpendicular to the surface on which the apparatus is applied.
Figure 2:
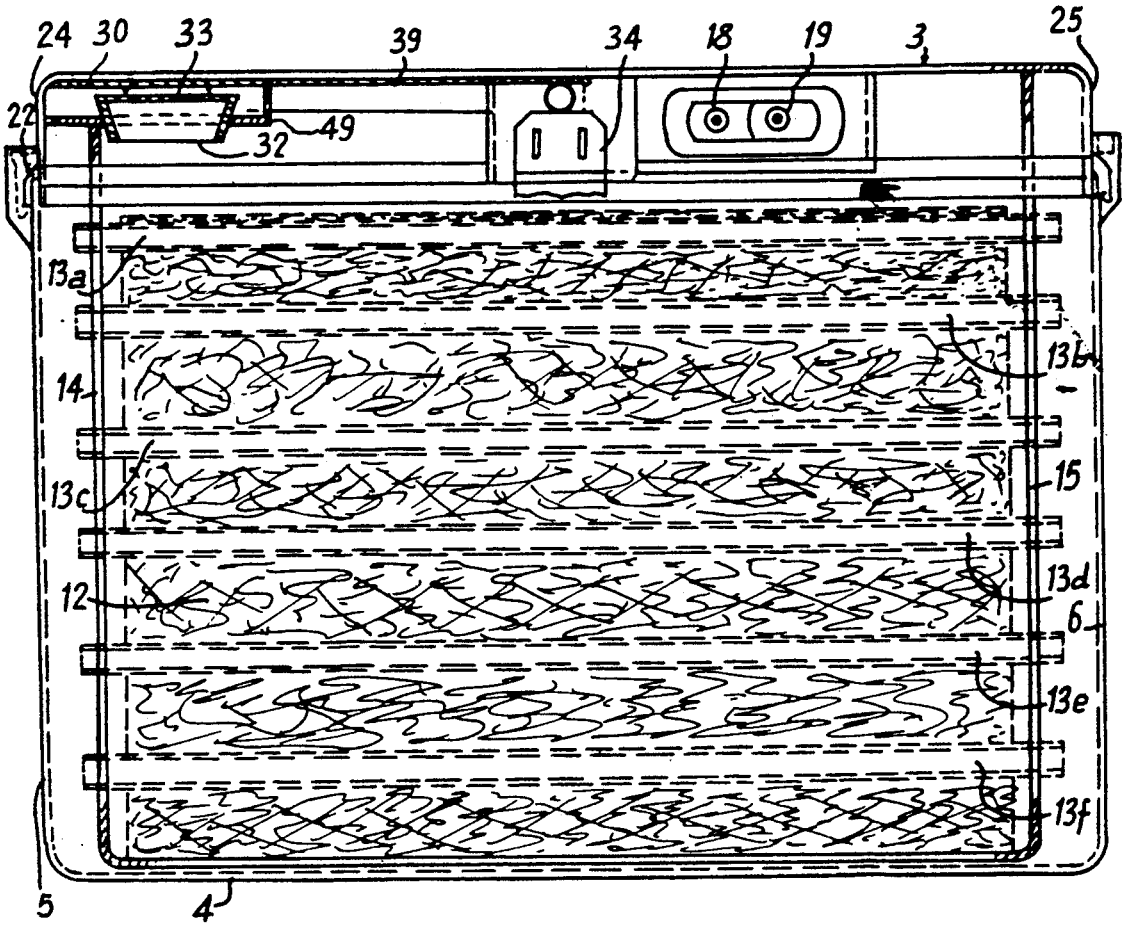
FIG. 2 is a view in vertical section made along line II—II of FIG. 1.
Figure 3:
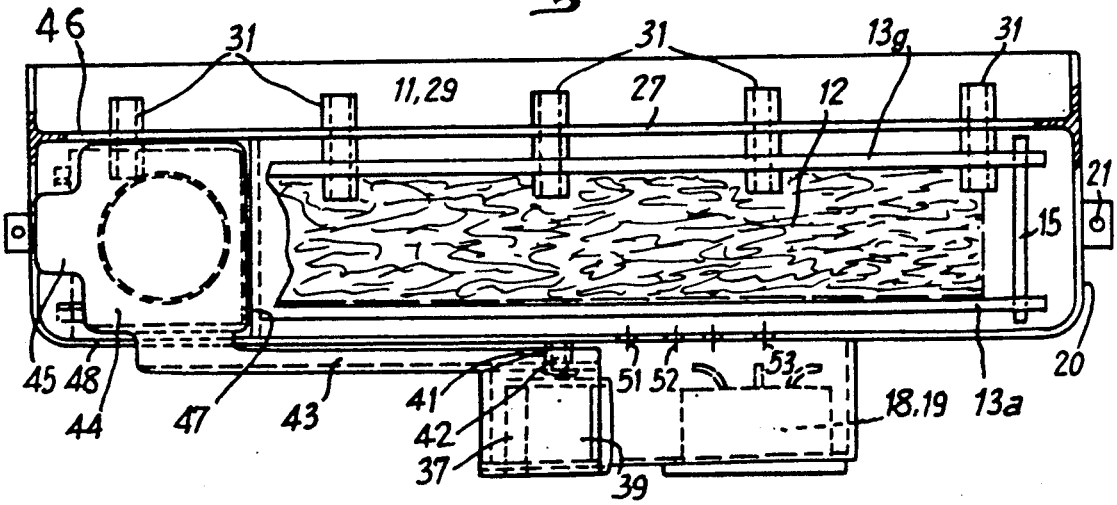
FIG. 3 is a view in horizontal section made along line III—III of FIG. 1.

If reference is made to FIGS. 1 to 3, it is seen that these Figures show an electro-portable apparatus according to the invention for the production of steam intended to be applied to a surface 1, for example for the purpose of ungluing a wall coating such as a wallpaper adhering to this surface. The apparatus comprises a two-part housing, which is constituted by a lower parallelepipedic box 2 and an upper cover 3. The lower box 2 comprises a horizontal bottom 4, two vertical side walls 5, 6, a vertical rear wall 7 and a vertical partition wall 8 extending between the two lateral walls 5 and 6, parallel to the rear wall 7. The partition wall 8 defines, with the rear wall 7, a rear compartment 9 which is closed and, on the opposite side, a front compartment 11, which is open and which constitutes part of a vaporization cavity or of a "steam plate". In the rear compartment 9 is housed a steam generator proper constituted by a parallelepipedic porous body 12 intended for storing water to be vaporized, and by heating means 13 constituted by parallel, horizontal electrodes in contact with the porous body 12. This porous body 12 may be 160 mm in height, 200 mm wide and 30 mm thick, this body being cut out from a mattress of rock fibers of which the fiber diameters are in majority between about 1 micrometer and 3.5 micrometers and of which the length ranges for example from 5 mm to 15 mm. These fibers preferably form, by assembly, laminated layers parallel to the heating electrodes, being maintained by a binding agent promoting the impregnation of the water. In the example in question, the porous body 12 has an original density of 75 kg/m$^3$ which, by slight compression between the heating electrodes, presents a final density of 130 kg/m$^3$ for a width of 30 mm.

In the embodiment of the invention described by way of non-limiting example, the heating means 13 are constituted by twelve horizontal electrodes 13*a*, 13*b*, . . . 13*l* which are distributed, in pairs of electrodes located at the same level, on the two large front and rear vertical faces of the porous body 2. Consequently, the rear face of the porous body 2 bears the electrodes 13*a*, 13*b*, . . . 13*f*, which extend horizontally and follow one another from top to bottom in that order. The front face of the porous body 2, i.e. that which lies near the partition wall 8, bears in the same way the electrodes 13*g*, 13*h*, . . . 13*l*, which extend horizontally and follow one another from top to bottom in that order. The electrodes are for example made of copper and are preferably shaped so as each to have a U-shaped cross section. Each electrode is applied against the porous body by its web and the two arms of each U extend outwardly. The electrodes 13*a*–13*l* advantageously have a length such that they project beyond either side of vertical uprights 14, 15 disposed on the sides of the two small vertical faces of the porous body 12, in the immediate vicinity thereof. The uprights 14, 15 are fast, at their upper ends, with the cover 3. Each of these uprights 14, 15 is pierced with twelve holes in which are engaged the end parts of the horizontal electrodes 13*a*–13*l*. The distances between the electrodes are variable from bottom to top. For example, the centre distance between the lowermost electrodes 13*e* (or 13*k*) is for example 52 mm, the centre distance between electrodes 13*d*, 13*e* (or 13*j*, 13*k*) is 24 mm, the centre distance located thereabove is 28 mm, then 24 mm, then 28 mm between the two uppermost electrodes (13*a*, 13*b*), and finally, 24 mm between electrodes 13*k*–13*l* and 13*e*–13*f*.

Figure 5:
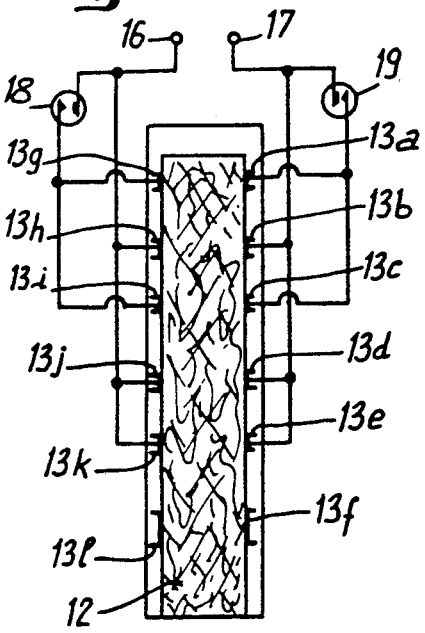
FIG. 5 is an electrical diagram of a device for commutation of the electrodes to adapt the steam generator to a range of resistivities of the water and/or to vary the output of steam produced.
Figure 4:
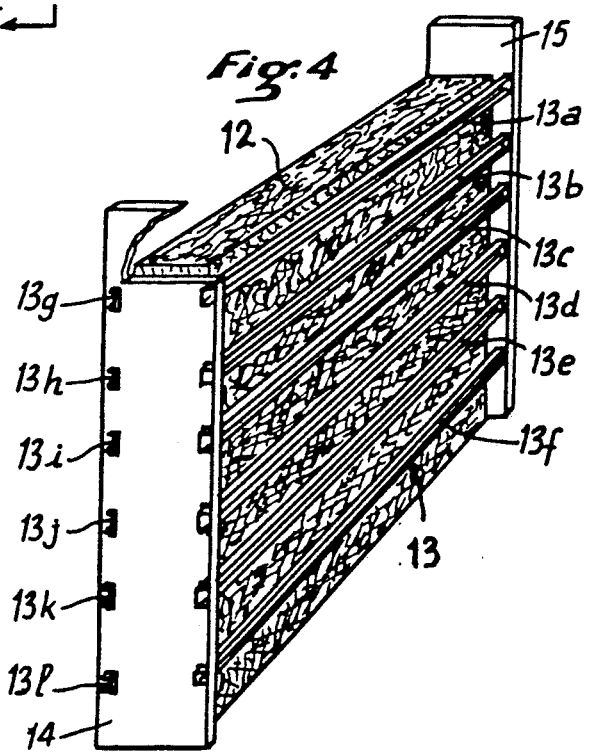
FIG. 4 is a view in perspective of the steam generator proper of the apparatus according to the invention.

FIG. 5 is a diagram of an electrical wiring for commutation of the electrodes 13*a*–13*l* to operate the steam generator apparatus at a mean power of 1500 watts, for a range of resistivity of the water ranging from 850 cm to 2200 cm. In this example of wiring, the electrodes 13*h*, 13*j* and 13*k* placed on the front face of the porous body 12, and possibly electrode 13*l*, are electrically connected together to a phase of the mains 16 whilst electrodes 13*b*, 13*d* and 13*e* and possibly electrode 13*f* which are disposed respectively at the same level as the preceding ones on the rear face of the porous body 12, are connected to the other phase 17 of the mains, for a voltage of 220 volts. In other words, the three pairs of electrodes 13*b* 13*h*, 13*d* 13*j*, 13*e* 13*k* which are located at the same level, are connected in parallel to the two phases 16, 17 of the mains. Furthermore, the front electrodes 13*g*, 13*i* are connected together and to a contact of a switch 18 of which the other contact is connected to phase 16, whilst the rear electrodes 13*a* and 13*c* are connected together and to a contact of a switch 19 of which the other contact is connected to the other phase 17 of the mains. In other words, the pairs of electrodes 13*a* 13*g* and 13*c* 13*i* which are located at the same level, are connected in parallel, via the switches 18, 19, to the two phases 16, 17 of the mains.

As may be seen in FIGS. 1 and 2, the cover 3 of the apparatus is fixed to the lower box 2 by means of screws 21, with the interposition of a seal 22. The cover 3 has a shape complementary of that of the lower box 2, i.e. it comprises an upper horizontal wall 23, of the same extent as the bottom 4 of the box 2, two vertical lateral walls 24, 25 joined to the vertical lateral walls 5, 6 of the box 2, a vertical rear wall 26 joined to the vertical rear wall 7 of the box 2 and a vertical partition wall 27 joined to the partition wall 8 of the box 2 and extending between the two vertical lateral walls 24 and 25. The vertical partition wall 27 thus defines, in the cover 3, two compartments, namely a rear compartment 28 located above the rear compartment 9 of the box 2 and a front compartment 29 located above the front compartment 11 of the box 2, the two front compartments 11 and 29 together constituting the vaporization cavity or the "steam plate" intended to be applied, by its peripheral edge, on the surface 1 having to receive the steam.

The vertical partition wall 27 of the cover 3 is traversed by tubes 31 extending horizontally and causing the two rear and front compartments 28 and 29, respectively, to communicate, in order to convey the steam produced towards and into the vaporization cavity constituted by the front compartments 11 and 29. According to a variant, passages may be provided, in place of the tubes 21 or in addition thereto, between the two rear and front compartments 9 and 11, respectively, of the box 2 at any height, in the partition wall, so as optimally to distribute the steam produced.

The cover 3 also comprises an orifice 32 intended for filling the apparatus with water, this orifice 32 being closed by a stopper 33.

On the rear side, the lower box 2 is fast with a vertical handle 34 connected, at its upper and lower ends, to the rear wall 7 of the box 2 and in this handle 34 passes a cord 35 for electrical supply, connected to the mains, which terminates, at its upper end, at a female socket 36. This female socket is engaged in a male plug 37 borne by an upper extension 38 of the handle 34. The female socket 36 passes through an opening having a section of the same shape as the cross section of the female socket 36, which is made in a vertical flange 39*a*, extending downwardly, to the rear of the extension 38, of an angle-shaped piece 39 made of plastics material. This angle-shaped piece 39 is articulated on the cover 3 and to that end it is fast with a pivot 41 on which it is maintained by means of a screw 42. The angle-shaped piece 39 is fast with a lever arm 43 extending horizontally, along the upper part of the rear wall 26 of the cover 3, and this lever arm 43 is fast, at its end, with a cover 44 disposed above the water filling orifice 32 closed by the stopper 33 which is fast with the cover 44, therebelow. This cover 44 which comprises a tongue 45 for gripping, is fitted between walls 46, 47 and 48 of the cover 3 of the apparatus so that filling of water is effected in a basin of which the lower part is indicated at 49 in FIG. 2.

Furthermore, as may be seen in FIG. 3, the rear wall 26 of the cover 3 of the apparatus bears tight passages 51, 52, 53 for the electrical connection wires connected to the electrodes of the steam generator, according to the wiring diagram of FIG. 5, and which terminate at the contacts of the switches 18, 19 which are borne by the extension 38 of the handle 34, between this extension and the rear wall 7 of the box 2.

In the particular embodiment of the invention described hereinabove, the general dimensions of the apparatus are a length of 255 mm, a height of 185 mm and a thickness of 65 mm, including an inner width of 50 mm for housing the water storage and vaporization device.

The apparatus according to the invention, which has been described, operates as follows: Firstly, to fill the storage and vaporization device with water, the female socket 36 is withdrawn from the male plug 37, which releases the angle-shaped piece 39. In this way, the lever arm 43 and the water admission cover 44 are released. The water admission cover 44 may then be raised with the aid of the tongue 45, to place this assembly in vertical position, which thus makes it possible to fill the apparatus with water through the orifice 32, either by means of a jet issuing from a tap or from any recipient. The apparatus is thus totally filled until the water appears at the height of the filling orifice 32. Then the porous body 12 is left to be impregnated with water, for a few seconds, then, by turning the apparatus over, the excess water contained around the porous body 12 is eliminated. The device thus having been impregnated, there remains only to fold down the water admission cover 44 and consequently the stopper 33 closing the orifice 32 so that the lever arm 43 comes into horizontal position. In this position, the opening of the angle-shaped piece 39 lies opposite the male plug 37, which makes it possible to introduce, through this opening, the female socket 36 in the male plug 35. From that moment, the electrodes of the steam generator unit are live and the electrical current passes through the water contained in the porous body 12 to heat it then vaporize it. The steam thus produced is distributed in the whole of the box 2 and in the inner compartment 28 of the cover 3, and this steam escapes through the tubes 31 to arrive in the vaporization cavity or the "steam plate" constituted by the front compartments 11, 29. The steam thus arrives on the wallpaper to be unglued when the apparatus is applied on the wall 1.

It should be noted that, when the water filling orifice 32 is accessible, it is impossible to position the female socket 36 since the angle-shaped piece 39 covers the entrance of the male plug 37, which thus provides perfect safety with regard to a risk of electrocution, being given that the electrodes are no longer live during filling with water.

Similarly, it should be noted that, by eliminating the excess water, after filling of the porous body, the elimination is thus effected by foreign bodies which may accumulate in the porous body as well as in the vaporization enclosure.

Figure 6:
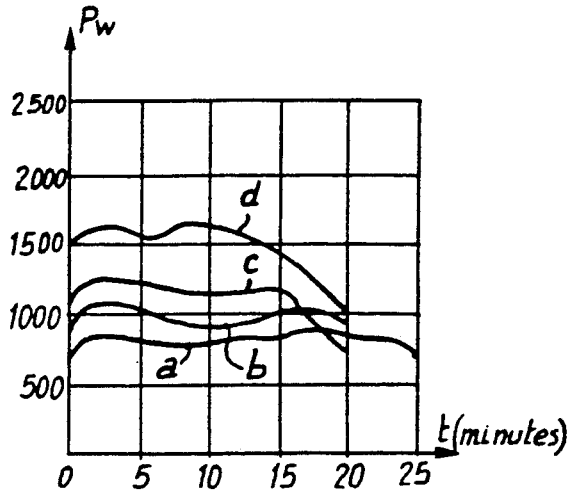
FIG. 6 is a diagram showing different profiles of steam output obtained by commutation during a period of 20 mins.

When the apparatus is switched on, depending on the resistivity of the water used or the desired flowrate of steam, the results obtained as a function of the positioning of switch 18, 19 in two positions are indicated hereinafter. The diagram of FIG. 6 shows four examples of results representing four profiles of steam flowrates obtained with the apparatus described hereinabove. The dissipated power, expressed in watts, is plotted on the y-axis whilst the time is plotted on the x-axis, in minutes. Curves a, b, c are representative for the use of water having a resistivity of 2000 cm. Curve a corresponds to the case of the two switches 18, 19 being open (relatively low flowrate of steam); curve b corresponds to the case of switch 18 being open and switch 19 being closed (average flowrate of steam), whilst curve c corresponds to the case of the two switches 18 and 19 being closed (high flowrate of steam). Curve d represents the case of using water having a resistivity of 1000 cm when switches 18 and 19 are open. In this example of result and for an apparatus of design with relatively moderate cost price, its use is thus ensured in the range of resistivity of water distributed for a maximum power of 2000 watts, whilst making it possible to obtain relatively constant steam flowrate profiles and a sufficient autonomy for these types of works.

To ensure a greater versatility of use of the apparatus, when, for example, it is desired to obtain progressive flowrates of steam, the apparatus may be equipped with an electronic power variator making it possible to vary this power between 0 and 100%. In general, for example, a triac is used, associated with different components of which a potentiometer ensures the desired adjustment of the flowrate of steam. When this device forms an integral part of the apparatus for ungluing the wallpaper, the interconnection diagram of the electrodes becomes the following: according to FIG. 5, the electrodes 13*g*, 13*h*, 13*i*, 13*j*, 13*k* and possibly 13*l* are placed in parallel, then likewise electrodes 13*a*, 13*b*, 13*c*, 13*d*, 13*e* and possibly 13*f*, of which each of the interconnections is connected to the electronic circuit. In addition to the possibility of adjustment of the flowrate of steam, this circuit presents the advantage of broadening the range of use of the resistivity of the water.

Another type of electronic circuit may also be used, for example based on triac, whose function, by the use for example of a Zener diode, will ensure a constant power despite wide deviations in resistivity of the water used. In that case, an apparatus may be developed with two positions of steam flowrate corresponding, for example, to two powers: 1000 watts and 1500 watts.

In this way, by these different ways of supplying the vaporization device with electrical current, it is possible to offer a whole range of apparatus to give the consumers a choice as well as a price range.

Figure 7:
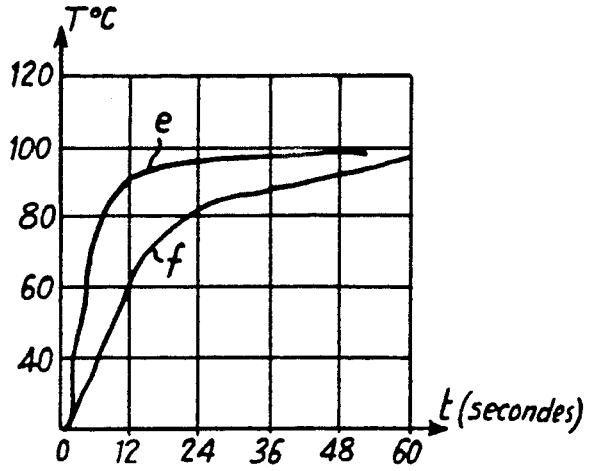
FIG. 7 is a diagram comparing the times of raising the temperature of the wallpaper between an apparatus according to the invention and a stripper whose boiler rests on the floor, for the same dissipated power.

The diagram of FIG. 7 shows the results comparing the times of rise of temperature of the paper obtained with the apparatus according to the invention and with a known wallpaper stripper of which the boiler rests on the floor, provided with its pipe connected to a steam plate. This measurement was carried out by inserting thermocouples in the plaster close to the wallpaper and, in both cases, the time necessary for reaching 100° C. was measured. The temperature, in °C., is plotted on the y-axis as a function of the time, plotted on the x-axis, in seconds. Curve e is relative to the stripper according to the invention, and curve f to the boiler on the floor. Being given that the softening point of the glues lies towards 75° C., it will be noted that less than half the time is required, to the benefit of the invention, to obtain the same result when the two apparatus have the same power. Inversely, for half the power, the works can be carried out in the same time.

Figure 8:
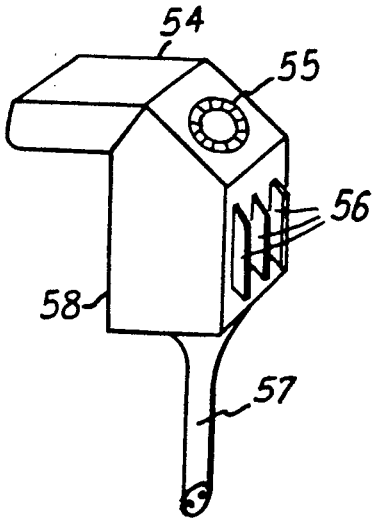
FIG. 8 is a view in perspective of an electronic device for controlling the steam generator associated with the electrical supply plug of the electro-portable apparatus according to the invention.

FIG. 8 is an embodiment of an electronic device for controlling the vaporizer which may be associated with the female supply socket of the apparatus. This assembly is composed of a female socket 54 which may be housed in the male plug 37, an adjusting knob 55, for example fast with a potentiometer for controlling the electronic circuit to vary the flowrate of steam, a calorie dissipator 56 for evacuating the heat from the triac by its association therewith, an electrical supply cord 57 and a hermetic assembly 58 containing the components of the circuit If, in the embodiment of the water storage and vaporization device described previously, only one porous body unit has been used, the latter may be made differently, for example in the form of three elementary porous bodies mounted horizontally, comprising, for example, two electrodes each, these elementary porous bodies being spaced apart by 5 mm from one another. Similarly, if porous bodies having a density of 130 $kg/m^3$ have been used, a density range of between 90 $kg/m^3$ and 180 $kg/m^3$ may be used, with similar results for this type of apparatus and depending on the types of electronic control devices. Similarly, other types of porous materials may be used, for example glass fibers, or, for example, cellular materials. Likewise, if the distance between the electrodes is 30 mm for a voltage of 220 volts, said distance may be included between 25 mm and 35 mm. If it is desired to create a range of apparatus by taking into account the optimizations for each, it is possible to act on compromises: choice of material, type and density of the porous bodies, location and distance of the electrodes, width and nature of the material thereof, quantity of complementary water capable of surrounding the porous body to increase its duration of autonomy without refill, etc.. to satisfy the power, the supply voltage, the weight, bulk, life duration of the product, cost price, etc. . . . The general or particular design of the elements of the apparatus may also be changed, for example its general shape, location of water admission, its means for obturation of the water admission, for example, place a rack to actuate masking of the socket, or actuate a switch breaking the two poles of the mains, in connection with the stopper of the water admission orifice, or, for example, locate differently the orifices serving the steam in the plate, etc. . . . and other devices for controlling operation of vaporization may likewise be applied thereto without departing from the scope of the invention.

From the embodiment of the water storage and vaporization device, it is also possible to broaden the range of the wallpaper stripper by using, for example, other sources of energy, for example gas, other types of design of the electronic device for controlling the vaporization unit, and other ways of effecting its water supply, for example by a pump drawing the water from a recipient and controlled for example by a vaporization current level detection which thus affects the operation of the pump.

I claim:

1. Electro-portable apparatus for producing steam applied to a surface 1, usable more particularly but not exclusively for ungluing wall coatings, comprising:

a housing 2, 3 containing a porous body 12 impregnated with a liquid to be vaporized solely in impregnated form directly in the porous body without the formation of a permanent layer in the housing, and means for heating this liquid up to its temperature of vaporization;

a partition wall 8, 27, subdividing said housing 2, 3 into two compartments, namely a rear closed compartment 9, 28 containing a steam generator 12, 13 consisting of the porous body 12 impregnated with liquid and the means 13 for heating said liquid, and a front compartment 11, 29 forming a vapor cavity or "steam plate", open to the outside, defined by a peripheral edge able to be applied on the surface 1 adapted to receive the vapor; and openings 31 provided through the partition wall 27 to allow the passage of the steam, produced in the rear compartment 9, 28 towards and into the front compartment 11, 29 constituting the vapor cavity or "steam plate".

2. Apparatus according to claim 1, wherein the housing comprises a lower parallelepipedic box 2 and an upper cover 3, the lower box 2 comprising a horizontal bottom, 4 two vertical lateral walls 5, 6, a vertical rear wall 7 and a vertical partition wall 8 extending between the two lateral walls 5, 6, parallel to the rear wall 7, and defining, with the rear wall 7, the rear compartment 9 which is closed and, on the opposite side, a front compartment 11, which is open, the cover 3 having a shape complementary to that of the lower box 2, i.e., it comprises an upper horizontal wall 23, of the same extent as the bottom 4 of the box 2, two vertical lateral walls 24, 25 joining the vertical lateral walls 5, 6 of the box 2, a vertical rear wall 26 connected to the vertical rear wall 7 of the box 2 and a vertical partition wall 27 joining the partition wall 8 of the box 2 and extending between the two vertical lateral walls 24, 25, the vertical partition wall 27 thus defining in the cover 3, two compartments, namely a rear compartment 28 located above the rear compartment 9 of the box 2 and a front compartment 29 located above the front compartment 11 of the box 2, the two front compartments 11, 29 together constituting the vapor cavity or the "steam plate".

3. Apparatus according to claim 2, wherein the vertical partition wall 27 of the cover 3 is traversed by tubes 31 extending horizontally and causing the two rear 28 and front 29 compartments of the cover 3 to communicate in order to convey the steam produced towards and into the vaporization cavity constituted by the front compartments 11, 29.

4. Apparatus according to claim 2, wherein on the rear side, the lower box 2 is fast with a vertical handle 34 connected, at its upper and lower ends, to the rear wall 7 of the box 2 and in this handle 34 passes an electrical supply cord 35, connected to the electrical supply mains, which terminates, at its upper end, in a female socket 36 which may be engaged in a male plug 37 borne by an upper extension 38 of the handle 34.

5. Apparatus according to claim 4, wherein the female socket 36 passes through an opening, having a section of the same shape as the cross section of the female socket 36, which is made in a vertical flange 39*a*, extending downwardly, to the rear of the extension 38, of an angle-shaped piece 39 which is articulated on the cover 3 and which is fast with a lower arm 43 extending horizontally, along the upper part of the rear wall 26 of the cover 3, this lever arm 43 being fast, at its end, with a cover 44 disposed above a water filling orifice 32 closed by a stopper 33.

6. Apparatus according to claim 5, wherein the water admission cover 44 comprises a tongue 45 for gripping and is fitted between walls 46, 47, 48 of the cover 3 of the apparatus so that filling with water is effected in a basin 49.

7. Apparatus according to claim 1, wherein the steam generator comprises a parallelepipedic porous body 12 for storing the liquid to be vaporized, and heating means 13 having parallel horizontal electrodes in contact with the porous body 12, said horizontal electrodes 13*a*, 13*b*, . . . 13*l* being distributed in pairs of electrodes located at the same level, on the two front and rear vertical large faces of the porous body 12.

8. Apparatus according to claim 7, wherein the electrodes 13*a*–13*l* have a length such that they project on either side of vertical uprights 14, 15 disposed on the two vertical small faces of the porous body 12, in the immediate proximity thereof, and fast, at their upper ends, with the cover 3, each of these uprights 14, 15 being pierced with holes in which are engaged the end parts of the horizontal electrodes 13*a*–13*l*.

9. Apparatus according to claim 7, wherein the pairs of electrodes 13*b* 13*h*, 13*d* 13*j*, 13*e* 13*k* are located at the same level and are connected in parallel to the two phases 16, 17 of the mains whilst other pairs of electrodes 13*a*, 13*g* and 13*c*, 13*i* are connected in parallel, via switches 18, 19, to the two phases 16, 17 of the electrical supply mains, the switches 18, 19 being open and/or closed as a function of the resistivity of the water to be vaporized and/or of the desired flow rate of steam.

10. Apparatus according to claim 9, wherein the rear wall 26 of the cover 3 of the apparatus bears tight passages 51, 52, 53 for the electrical connection wires connected to the electrodes of the steam generator and which terminates at the contacts of the switches 18, 19 which are borne by the extension 38 of the handle 34, between this extension and the rear wall 7 of the box 2.

11. Electro-portable apparatus for producing steam applied to a surface 1, usable more particularly but not exclusively for ungluing wall coatings, comprising:

a housing 2, 3 containing a porous body 12 impregnated with a liquid to be vaporized and means for heating the liquid up to its temperature of vaporization;

a partition wall 8, 27, for subdividing said housing 2, 3 into a rear closed compartment 9, 28 containing a steam generator comprising a porous body 12 impregnated with liquid and heating means 13 for heating the liquid and a front compartment 11, 29 forming a vapor cavity or "steam plate" open to the outside and defining by a peripheral edge able to be applied onto the surface 1 adapted to receive the vapor;

said partition wall being provided with openings 31 to allow the passage of the steam, produced in the rear compartment 9, 28 towards and into said front compartment 11, 29; and said steam generator comprising a parallelepipedic porous body 12 for storing the liquid to be vaporized, and heating means 13 including parallel horizontal electrodes in contact with said porous body 12, said horizontal electrodes 13*a*, 13*b*, . . . 13*l* being distributed in pairs of electrodes located at the same level, on the two front and rear vertical large faces of the porous body 12.

12. Apparatus according to claim 11, wherein said electrodes 13*a*–13*l* have a length such that they project on either side of vertical uprights 14, 15 disposed on the two vertical small faces of the porous body 12, in the immediate proximity thereof, and fast, at their upper ends, with the cover 3, each of said uprights 14, 15 being pierced with holes in which are engaged the end parts of the horizontal electrodes 13*a*–13*l*.

13. Apparatus according to claim 11, wherein said pairs of electrodes 13*b* 13*h*, 13*d* 13*j*, 13*e* 13*k* are located at the same level, and are connected in parallel to the two phases 16, 17 of the mains and other of said pairs of electrodes 13*a*, 13*g* and 13*c*, 13*i* are connected in parallel, via switches 18, 19, to the two phases 16, 17 of the electrical supply mains, the switches 18, 19 being open and/or closed as a function of the resistivity of the water to be vaporized and/or of the desired flow rate of steam.

14. Electro-portable apparatus for producing steam applied to a surface 1, usable more particularly but not exclusively for ungluing wall coatings, comprising:

a housing 2, 3 containing a porous body 12 impregnated with a liquid to be vaporized and means for heating this liquid up to its temperature of vaporization;

a partition wall 8, 27, for subdividing said housing 2, 3 into a rear closed compartment 9, 28 containing a steam generator comprising a porous body 12 impregnated with liquid and heating means 13 for heating the liquid and a front compartment 11, 29 forming a vapor cavity or "steam plate" open to the outside and defined by a peripheral edge able to be applied onto the surface 1 adapted to receive the vapor;

said partition wall being provided with openings 31 to allow the passage of the steam, produced in the rear compartment 9, 28 towards and into said front compartment 11, 29;

said housing 2, 3 comprising a lower parallelepipedic box 2 and an upper cover 3;

said lower box 2 comprising a horizontal bottom 4, two vertical lateral walls 5, 6, a vertical rear wall 7 and a vertical partition wall 8 extending between the two lateral walls 5, 6, parallel to the rear wall 7, and defining, with the rear wall 7, the rear compartment 9 which is closed and, on the opposite side, a front compartment 11, which is open; and said cover 3 having a shape complementary to that of the lower box 2, and comprising an upper horizontal wall 23, of the same extent as the bottom 4 of the box 2, two vertical lateral walls 24, 25 joining the vertical lateral walls 5, 6 of the box 2, a vertical rear wall 26 connected to the vertical rear wall 7 of the box 2 and a vertical partition wall 27 joining the partition wall 8 of the box 2 and extending between the two vertical lateral walls 24, 25, the vertical partition wall 27 thus defining in the cover 3 a rear compartment 28 located above the rear compartment 9 of the box 2 and a front compartment 29 located above the front compartment 11 of the box 2, the two front compartments 11, 19 together constituting the vapor cavity or the "steam plate".

15. Apparatus according to claim 14, wherein said steam generator comprises a parallelepipedic porous body 12 for storing the liquid to be vaporized and heating means 13 including parallel horizontal electrodes in contact with said porous body 12, said horizontal electrodes 13*a*, 13*b*, . . . 13*l* being distributed in pairs of electrodes located at the same level, on the two front and rear vertical large faces of the porous body 12.

16. Apparatus according to claim 15, wherein said electrodes 13*a*–13*l* have a length such that they project on either side of vertical uprights 14, 15 disposed on the two vertical small faces of the porous body 12, in the immediate proximity thereof, and fast, at their upper ends, with the cover 3, each of said uprights 14, 15 being pierced with holes in which are engaged the end parts of the horizontal electrodes 13*a*–13*l*.

17. Apparatus according to claim 16, wherein said pairs of electrodes 13*b* 13*h*, 13*d* 13*j*, 13*e* 13*k* are located at the same level, and are connected in parallel to the two phases 16, 17 of the mains and other of said pairs of electrodes 13*a*, 13*g* and 13*c*, 13*i* are connected in parallel, via switches 18, 19, to the two phases 16, 17 of the electrical supply mains, the switches 18, 19 being open and/or closed as a function of the resistivity of the water to be vaporized and/or of the desired flow rate of steam.

18. Apparatus according to claim 14, wherein said vertical partition wall 27 is traversed by tubes 31 extending horizontally and causing the two rear 28 and front 29 compartments to communicate in order to convey the steam produced towards and into said vapor cavity.

19. Apparatus according to claim 14, wherein said lower box 2 is fast with a vertical handle 34 connected, at its upper and lower ends, to the rear wall 7 of the box 2 and including an electrical supply cord 35 passing through said handle 34 and connected to the electrical supply mains, which terminates, at its upper end, in a female socket 36 which may be engaged in a male plug 37 borne by an upper extension 38 of the handle 34.

20. Apparatus according to claim 19, wherein the rear wall 26 of the cover 3 bears tight passages 51, 52, 53 for the electrical connection wires connected to the electrodes of the steam generator and which terminate at the contacts of the switches 18, 19 which are borne by the extension 38 of the handle 34, between this extension and the rear wall 7 of the box 2.

* * * * *